US006059925A

United States Patent [19]

Tigerstrom et al.

[11] Patent Number: 6,059,925

[45] Date of Patent: May 9, 2000

[54] METHOD TO REGENERATE GAS MIXTURE IN OZONE-BLEACHING PROCESS

[75] Inventors: Anna Tigerstrom, Stockholm; Ulf Persson, Uppsala, both of Sweden

[73] Assignee: AGA Aktiebolag, Lidingo, Sweden

[21] Appl. No.: 08/849,521

[22] PCT Filed: Nov. 2, 1995

[86] PCT No.: PCT/SE95/01296

§ 371 Date: Aug. 8, 1997

§ 102(e) Date: Aug. 8, 1997

[87] PCT Pub. No.: WO96/15318

PCT Pub. Date: May 23, 1996

[30] Foreign Application Priority Data

Nov. 14, 1994 [SE] Sweden ..... 9403912

[51] Int. Cl.[7] ..... D21C 11/06; D21C 9/147; D21C 9/153

[52] U.S. Cl. ..... 162/15; 162/30.11; 162/65

[58] Field of Search ..... 162/18, 39, 40, 162/15, 30.11, 65

[56] References Cited

U.S. PATENT DOCUMENTS

| | | | |
|---|---|---|---|
| 3,764,464 | 10/1973 | Samuelson | 162/65 |
| 5,145,557 | 9/1992 | Peter et al. | 162/40 |
| 5,164,044 | 11/1992 | Griggs et al. | 162/57 |
| 5,296,097 | 3/1994 | Friend | 162/18 |
| 5,439,556 | 8/1995 | Sethna et al. | 162/30.11 |
| 5,695,604 | 12/1997 | Rounsaville et al. | 152/65 |

FOREIGN PATENT DOCUMENTS

| | | |
|---|---|---|
| 0406218 | 1/1991 | European Pat. Off. . |
| 0526383 | 2/1993 | European Pat. Off. . |
| 0588704 | 3/1994 | European Pat. Off. . |
| 9500826 | 9/1995 | Sweden . |
| 88/04706 | 6/1988 | WIPO . |

*Primary Examiner*—Dean T. Nguyen
*Attorney, Agent, or Firm*—Pearne, Gordon, McCoy & Granger LLP

[57] ABSTRACT

A method of treating cellulose pulp which is subjected to an oxygen-delignification stage (3), a washing stage (4), an ozone-bleaching stage (1) and a further bleaching stage, for instance a peroxide-bleaching stage (7). A gas mixture of oxygen and ozone is delivered to the ozone-bleaching stage (1). The used gas mixture is regenerated, i.e. freed from carbon dioxide, and returned to the oxygen-delignification stage (3) and/or to a bleaching stage (7).

9 Claims, 4 Drawing Sheets

METHOD TO REGENERATE GAS MIXTURE IN OZONE-BLEACHING PROCESS

FIELD OF INVENTION AND DESCRIPTION OF THE KNOWN PRIOR ART

The present invention relates to a method of treating cellulose pulp using an oxygen-delignification stage and a peroxide-bleaching stage and the regeneration of the used oxygen and ozone gas mixture back to the delignification and/or bleaching stage.

Many of the known processes that are applied in the cellulose industry consume very large volumes of relatively expensive chemicals. In order for these processes to be viable economically, it is necessary to be able to reuse such chemicals to the greatest possible extent.

When cellulose pulp is bleached with a gaseous mixture that contains ozone and oxygen, for instance in amounts corresponding to about 10% $O_3$ and 85% $O_2$, these substances are consumed to some extent during the actual bleaching process. When coming into contact with the pulp, the gas mixture reacts therewith and carbon dioxide is formed. Ozone and possibly oxygen are consumed therewith. The gas leaving the treatment stage constantly contains large quantities of oxygen, and also carbon dioxide, nitrogen and possibly argon, among other things. The used gas could therefore be used to improve combustion or could be used in a bleaching or delignifying stage for instance, without needing to refine the gas. However, the use of the used gas mixture in an oxygen-delignification stage or in a bleaching stage is associated with certain drawbacks. The gas mixture namely consumes alkali, therewith making it necessary to adjust to a higher initial pH value. Furthermore, in comparison with the use of pure oxygen, the additional gas quantity represented by the gas mixture will probably result in channelling or tunnelling in the cellulose pulp, causing large quantities of gas to pass through the pulp to no useful end.

EP-A-406 218 teaches a method of producing oxygen and/or ozone for a consumer of these gases, wherein residual oxygen is recovered and purified in an adsorption device. The gas can then be returned to an oxygen consumer or passed to an ozone generator and thereafter to an ozone consumer. This document does not discuss the problem of carbon dioxide in the used gas mixture. The regeneration is primarily concerned with reducing hydrocarbon compound concentrations, primarily methane gas.

EP-A-526 383 teaches a method in which gas of high oxygen concentration is delivered to an ozone generator, there being generated an oxygen gas which is rich in ozone, having an ozone concentration of about 6 percent by weight. This gas is used to bleach cellulose pulp, there being obtained a used gas which contains contaminants, among other things a relatively large quantity of carbon dioxide. The used gas is regenerated by removing at least a part of the carbon dioxide. The regenerated gas can then be reused, and EP-A-526 383 suggests that the regenerated gas is mixed with fresh oxygen gas and returned to the ozone generator.

WO-A-8 804 706 teaches a method of washing alkaline pulp with the aid of carbon dioxide, which is delivered to the washing water either prior to or in the actual washing stage. This addition of carbon dioxide enables the pH value to be lowered and the washing process to be made more effective and therewith lower the water consumtion. The carbon dioxide added to the system is converted to carbonate ions and enhances the washing of organic substances (COD) and alkali from the pulp. The carbon dioxide is taken from an external source.

SUMMARY OF THE INVENTION

The object of the present invention is to improve the recovery and the use of used gas mixtures in the pulp treatment process and therewith make treatment of the cellulose pulp more effective.

This object is achieved with the initially defined method which includes the method steps set forth in the characterizing clause of the following claim 1.

Preferred embodiments of the invention are defined in claims 2–14.

When carbon dioxide is removed from the used oxygen-gas mixture in accordance with the inventive method, it is probable that the oxygen content of the mixture can be elevated and the regenerated gas mixture should therefore be better suited for use in an oxygen-delignification stage or in some other process stage in which pulp is treated with oxygen, for instance in a peroxide-bleaching stage or in an extraction stage. Because of the high oxygen concentration, the probability of channels or tunnels forming in an upwardly moving pulp flow is reduced, since it is possible to keep the gas volume at a lower level. Furthermore, the partial pressure of oxygen becomes higher at unchanged total pressures. The oxygen will therefore achieve better contact with the cellulose pulp, with greater effect in an oxygen-delignification process, for instance.

A further advantage achieved by the invention, is that in, e.g., an oxygen-delignification stage the initially high alkali content can be kept at a low level, since the carbon dioxide, which is an alkali consumer, has now been removed from the oxygen gas. With regard to pulp quality, it is extremely important that the highest alkali concentration, i.e. the initial concentration, can be kept at a low level, because the alkali present not only reacts with the lignin but also degrades cellulose.

Another advantage afforded by the inventive method is that when relatively inexpensive weak liquor is used to remove carbon dioxide, the cost of alkali used for neutralization purposes can be kept low.

When carbon dioxide is removed through the medium of washing water, the further advantage is afforded that carbon dioxide formed in the ozone-bleaching process can be used in the pulp treatment process. The carbon dioxide lowers the pH in the washing stage and achieves the desired removal of COD and alkali, primarily sodium. This obviates the need to supply the pulp wash with carbon dioxide taken from an external source.

BRIEF DESCRIPTION OF THE DRAWINGS

The present invention will now be described in more detail with reference to different preferred embodiments thereof and also with reference to the accompanying drawings, in which.

DETAILED DESCRIPTION OF PREFERRED EMBODIMENTS OF THE INVENTION

Figure 1:
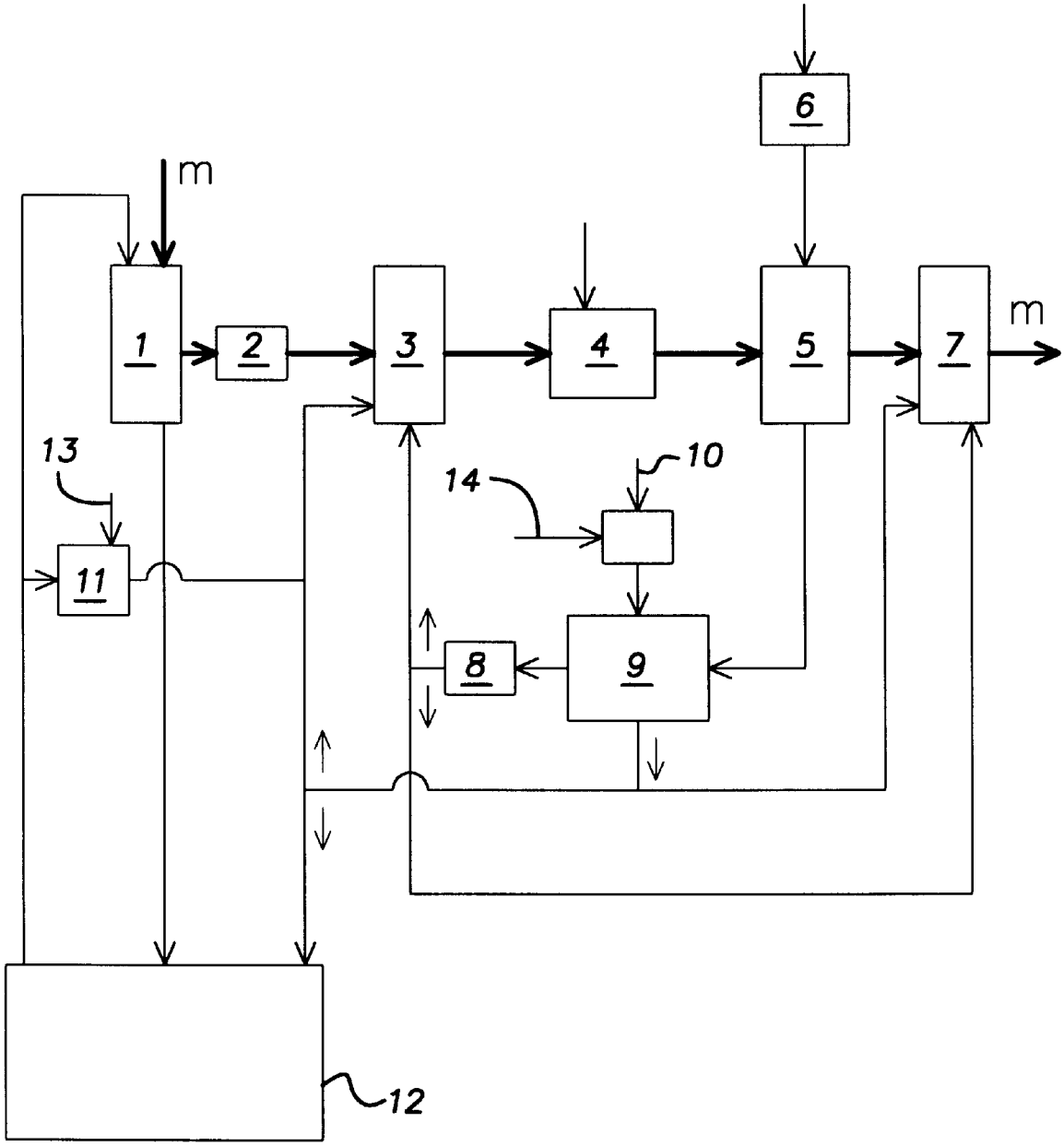
FIG. 1 is a schematic flow sheet illustrating the use of white liquor to remove carbon dioxide.

When practicing the different embodiments of the invention, wood chips are fed into a pulp cooker 1 together with the alkaline substances in white liquor, such as sodium hydroxide and hydrogen sulfide. The pulp m can then be washed in a washing stage 2, prior to being delivered to an oxygen-delignification stage 3. The delignified pulp m is washed in a washing stage 4, to which carbon dioxide is delivered in order to achieve the desired washing result. The pulp m is then bleached in an ozone-bleaching stage 5, to which an oxygen-gas mixture containing ozone and oxygen is delivered either in conflow with or in contraflow to the cellulose pulp in a bleaching reactor. Upon completion of the ozone-bleaching process, the pulp may be passed to a further washing stage (not shown) and bleaching stage 7, for instance a peroxide-bleaching stage, or to an extraction stage. The oxygen-gas mixture intended for the ozone-bleaching stage may, for instance, be taken from an ozone generator 6 in which part of the oxygen is converted to ozone, for instance to produce an oxygen-gas mixture 5 which contains 20 percent by weight ozone. The oxygen delivered to the ozone generator 6 may, for instance, be taken from an external source and may be highly concentrated, i.e. have a concentration close to 100%, or may be produced in a plant on site. wherein the concentration will be about 90 to 96%, for instance. When the oxygen-gas mixture has been passed through the bleaching reactor 5, the majority of the ozone will have been consumed, i.e. reacted with other substances, to form a significant quantity of carbon dioxide. For instance, the used gas mixture may contain about 90% oxygen, about 5% carbon dioxide, residual quantities of ozone and minor quantities of nitrogen and, e.g., argon, this latter depending on the quality of the incoming gas mixture and the air-content or gas-content of the pulp.

Subsequent to completion of the ozone-bleaching process, the used gas mixture is delivered to the apparatus 9 for the removal of carbon dioxide, wherein the carbon dioxide is allowed to react with alkali and form bicarbonate, carbonate or both, depending on the pH value. The used gas mixture may also be freed of its residual ozone content in an ozone destructor 8.

The regenerated gas mixture which has been liberated of its carbon dioxide content will thus have a relatively high oxygen concentration and can then be used in the pulp treatment process, and is delivered to the oxygen-delignification stage 3 and to the further bleaching stage 7.

The system may also include a chemical recovery cycle 12 and a reactor 11 for generating oxidized white liquor by supplying air or oxygen at 13. Each individual process stage illustrated schematically with respect to the different embodiments may include several sequential stages. For instance, the washing stage 4 may consist of several successive stages where the wash water is passed in contraflow to the pulp from stage to stage. Each stage may include several parts, such as mixer reactor and gas/pulp separator. The term gas-mixture is also intended to include a gas mixture which is comprised essentially of only one gas.

Embodiment 1

In accordance with a first embodiment of the invention, see FIG. 1, an oxygen-gas mixture of ozone and oxygen is delivered to the bleaching reactor 5, together with cellulose pulp. The used gas mixture is then passed to a scrubber 9, to which white liquor is also supplied at 10. The white liquor alkalies function to remove the carbon dioxide present in the gas mixture, this carbon dioxide being converted to bicarbonate $(HCO_3)^-$ and/or carbonate The thus regenerated gas has a high oxygen content and is then delivered to the oxygen-delignification stage 3. The generated gas mixture may also be delivered to the peroxide-bleaching stage or to the extraction stage 7. Preferably, the amount of white liquor delivered to the scrubber 9 will only correspond to the amount required to remove all of the carbon dioxide present. Liquor residues are then handled conventionally in the chemical recovery system 12. If more white liquor is supplied, the used white liquor can also be delivered to the delignifying stage and/or the peroxide-bleaching stage or the extraction stage.

In addition to removing carbon dioxide, this embodiment also enables complete oxidation of the sulphur components of the white liquor to be achieved, among other things. In this case, any ozone that remains can be advantageous to the oxidation process. In this case, air can also be supplied to the white liquor, at 14, with the intention of oxidizing the hydrogen sulfide content of the white liquor, to form thiosulfate. The reaction to sulfate then takes place in a reactor 9. The total oxidized white liquor is passed to the peroxide-bleaching stage and/or to the delignifying stage, in which it is beneficial by virtue of the fact that it contains no oxidized components that can influence reactions of the pulp in an undesirable sense.

Scrubbing of the used gas mixture obtained from the ozone-bleaching stage with white liquor will thus produce a regenerated gas mixture that has a high oxygen content and a low carbon dioxide content. Because of the low carbon-dioxide content, less alkali is consumed when the regenerated gas mixture is used in the oxygen delignification stage or in a bleaching stage, for instance a peroxide-bleaching stage, than that consumed when the used gas mixture is delivered directly to said stages without being regenerated. This increases the selectivity in said stages, because it is possible to maintain a lower pH at the beginning of the reaction with a retained final pH. An excessively high initial pH will result in a pulp of poor quality. In other words it results in low selectivity. The consumption of alkali can then be moved from the oxygen-delignification process to a position in the system which is more favourable to the pulp.

The reduced carbon dioxide content of the regenerated gas mixture will also reduce the probability of channeling or tunnelling in the upwardly moving pulp flow in the oxygen delignification stage and, for instance, in the peroxide-bleaching stage. Thus, as a result of this embodiment, the oxygen is more likely to come into effective contact with the pulp and therewith be used to a greater effect.

Embodiment 2

Figure 2:
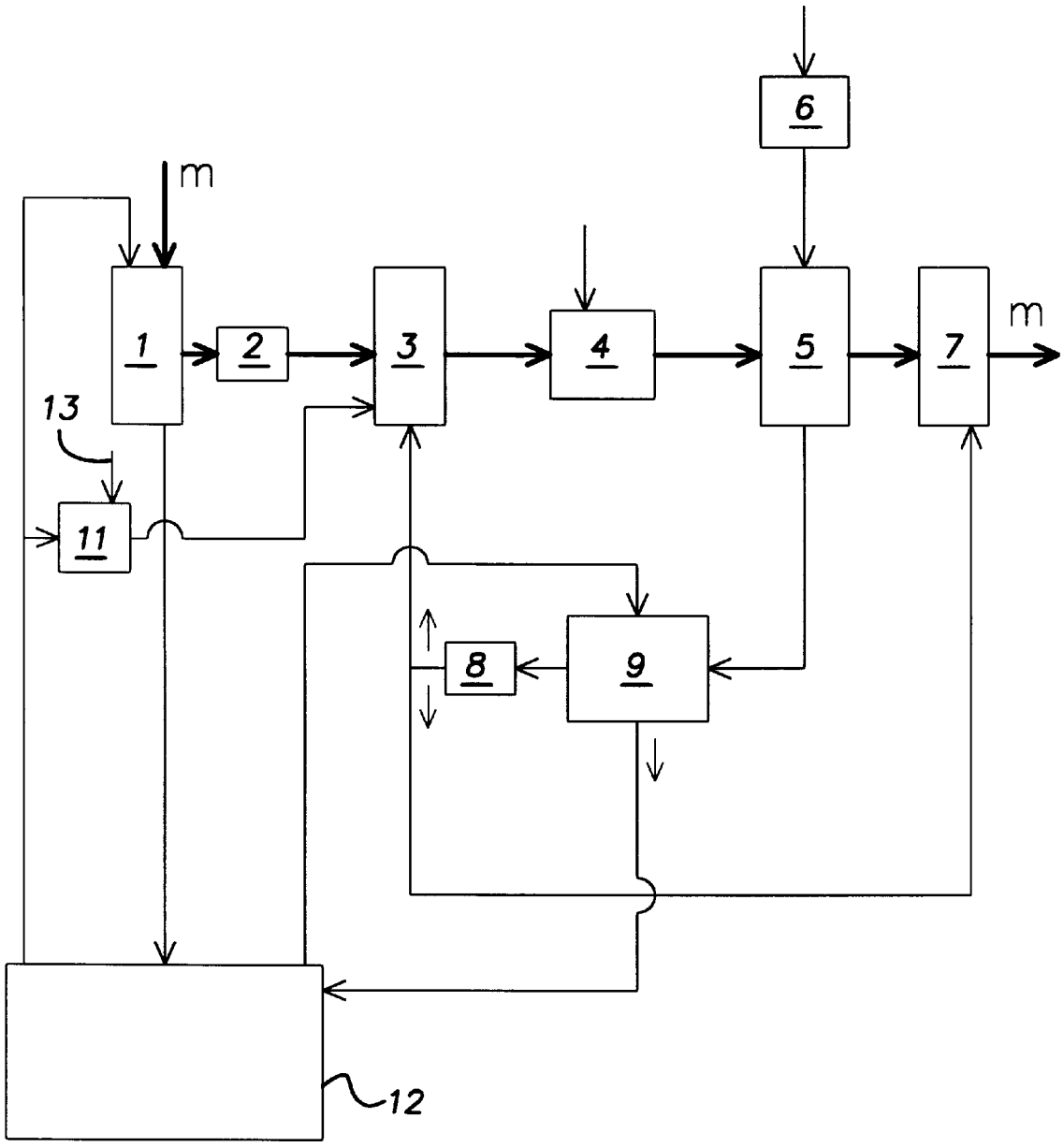
FIG. 2 is a schematic flow sheet illustrating the use of weak liquor to remove carbon dioxide.

According to a second embodiment of the invention, see FIG. 2, an oxygen-gas mixture containing ozone and oxygen is delivered to the bleaching reactor 5, together with cellulose pulp. The used gas mixture is thereafter passed to a scrubber 9, to which weak liquor is also supplied. The gas mixture is regenerated by virtue of the removal of carbon dioxide from the gas by the alkalis of the weak liquor, said carbon dioxide being converted to bicarbonate and/or carbonate. The regenerated gas mixture has a high oxygen content and a low carbon dioxide content and can be reused. The regenerated gas mixture is passed to the oxygen-delignification stage 3 and possibly also to a bleaching stage, e.g. for extraction and/or peroxide-bleaching purposes. The weak liquor can be extracted from the chemical recovery cycle. The used weak liquor is returned to the chemical recovery cycle. The aforementioned advantages regarding selectivity, reduced channelling and more effective use of the oxygen are also obtained with the second embodiment.

In addition, the second embodiment also affords the advantage of a reduction in alkali costs incurred by neutralization of the pulp, since such costs can be offset by using weak liquor that is available in the plant.

Embodiment 3

Figure 3:
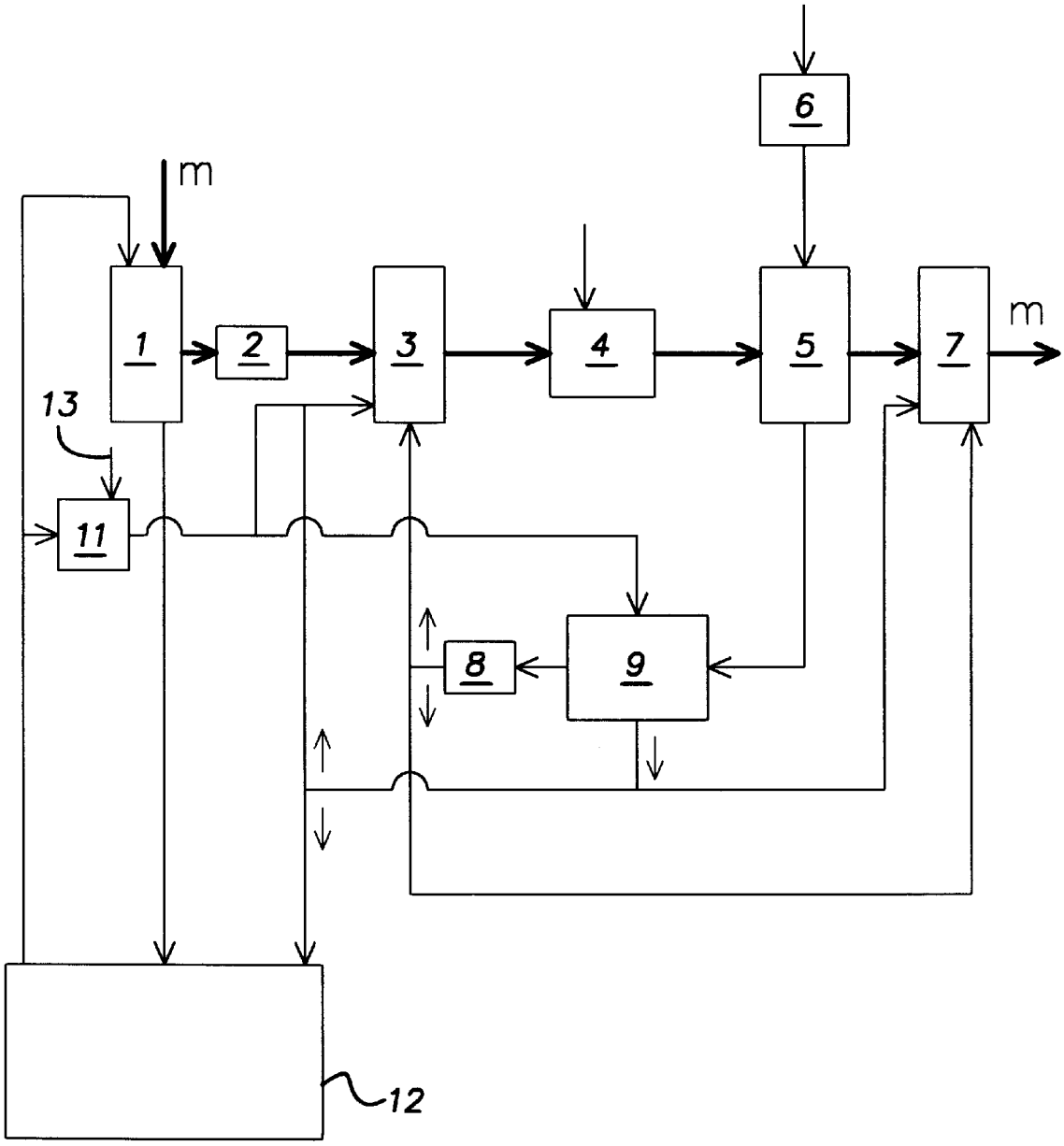
FIG. 3 is a schematic flow sheet illustrating the use of oxidized white liquor to remove carbon dioxide.

In accordance with a third embodiment of the invention, see FIG. 3, an oxygen-gas mixture containing ozone and oxygen is delivered to the bleaching reactor 5, together with cellulose pulp. The used gas mixture is thereafter passed to a scrubber 9, to which oxidized white liquor is also supplied. The gas mixture is regenerated by virtue of the removal of carbon dioxide in the gas by the alkalis of the oxidized white liquor, this carbon dioxide being converted to bicarbonate and/or carbonate. The regenerated gas mixture has a high oxygen content and a low carbon-dioxide content and can be reused and passed to the oxygen-delignification stage 3. The oxidized white liquor can be taken from a reactor 11 in which oxidized white liquor is produced. The oxidized white liquor taken from the scrubber is treated in the same way as the used liquor in the first embodiment. The aforesaid advantages regarding selectivity, reduced channelling and the use of the oxygen to a greater effect are also obtained with the third embodiment.

Embodiment 4

Figure 4:
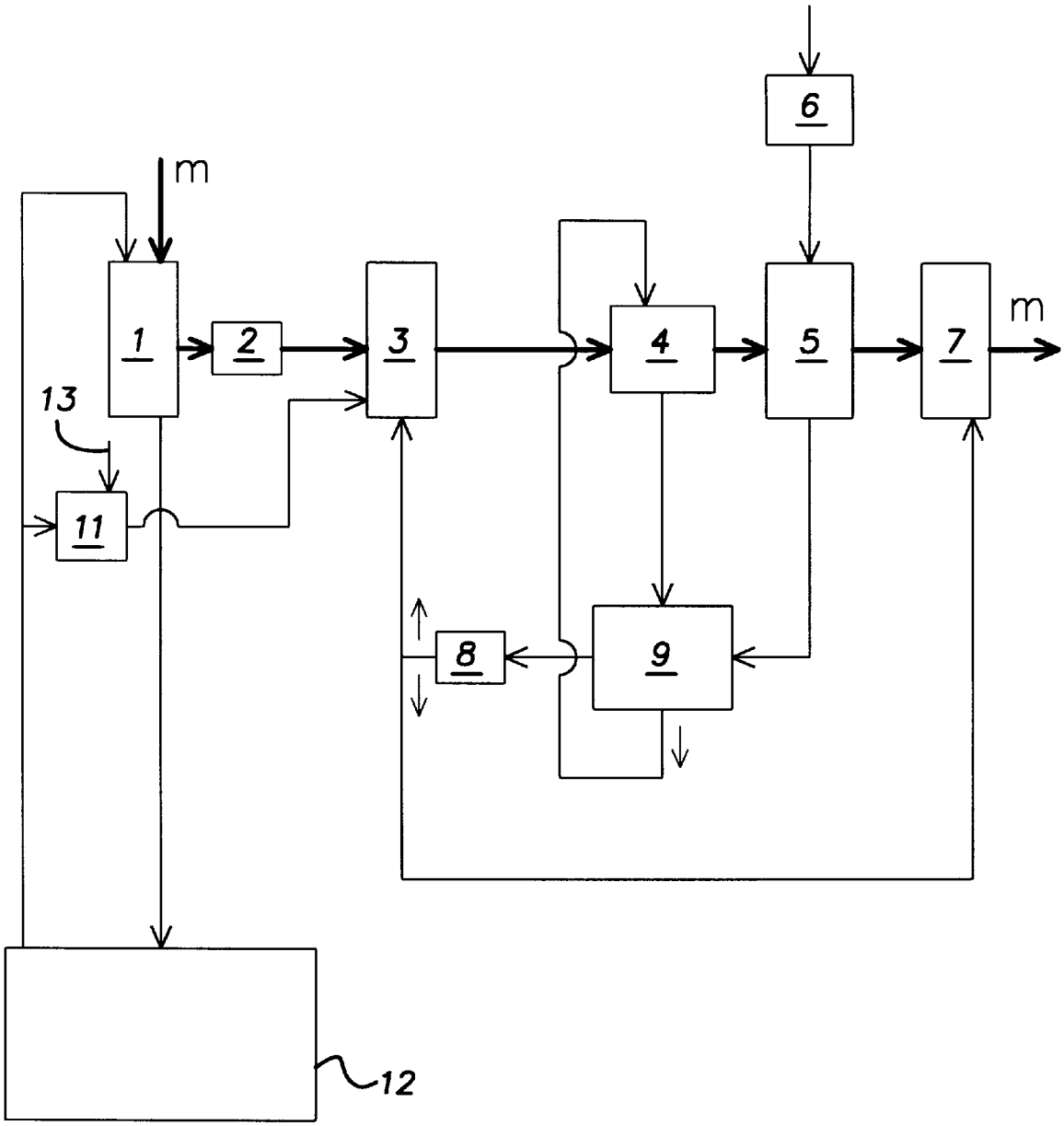
FIG. 4 is a schematic flow sheet illustrating the use of pulp wash water to remove carbon dioxide.

According to a fourth embodiment of the invention, see FIG. 4, an oxygen-gas mixture containing oxygen and ozone is delivered to the bleaching reactor 5, together with cellulose pulp. The used gas mixture is passed from the reactor 5 to a scrubber 9, to which alkaline washing water is also supplied from a pulp-washing stage 4, the carbon dioxide present in the gas mixture being converted to bicarbonate and/or carbonate. The regenerated gas mixture freed from carbon dioxide is used in the oxygen-delignification stage 3 and the aforesaid advantages regarding selectivity, reduced channelling in the pulp and the use of the oxygen to a better effect are also achieved with the fourth embodiment. Furthermore, this embodiment results in the production of a carbonate-containing washing water. This water can be passed back to the pulp-washing stage 4 and used again. The addition of carbon dioxide makes the wash more effective. This enables the carbon dioxide formed in the ozone-bleaching stage to be recovered and put to useful use. Thus, no carbon dioxide need be taken into the process from an external source.

What is claimed is:

1. A method of treating cellulose pulp comprising the steps of:

delignifying the pulp by contacting the pulp with a first gas mixture comprising oxygen;

washing the delignified pulp by contacting the pulp with a wash liquid;

bleaching the washed pulp by contacting the pulp with a second gas mixture comprising ozone and oxygen;

regenerating the second gas mixture from the bleaching step by contacting the second gas mixture with the wash liquid from the washing step, said regeneration of the second gas mixture converting carbon dioxide in the second gas mixture into a carbonate;

delivering at least a portion of said regenerated second gas mixture in the form of the first gas mixture to the delignifying step; and delivering at least a portion of the wash liquid from the regenerating step to the wash step.

2. The method of claim 1, wherein the carbonate comprises $HCO_3^-$.

3. The method of claim 1, wherein the carbonate comprises $CO_3^=$.

4. The method of claim 1, further comprising the step of removing ozone from the portion of the regenerated second gas mixture before the portion of the regenerated second gas mixture is delivered to the delignifying step.

5. The method of claim 1, further comprising the steps of:

peroxide bleaching the pulp after the pulp has been bleached with the second gas mixture; and delivering a second portion of the regenerated second gas mixture to the peroxide bleaching step.

6. The method of claim 1, wherein all of the regenerated second gas mixture is delivered to the delignifying step.

7. A method of treating cellulose pulp comprising the steps of:

delignifying the pulp by contacting the pulp with a first gas mixture comprising oxygen;

washing the delignified pulp by contacting the pulp with a wash liquid;

bleaching the washed pulp by contacting the pulp with a second gas mixture comprising ozone and oxygen;

regenerating the second gas mixture from the bleaching step by contacting the second gas mixture with a white liquor containing sulfur, said regeneration of the second gas mixture oxidizing sulfur in the white liquor to sulfate to form oxidized white liquor, and converting carbon dioxide in the second gas mixture into a carbonate;

delivering at least a portion of said regenerated second gas mixture in the form of the first gas mixture to the delignifying step; and delivering at least a portion of the oxidized white liquor formed in the regenerating step to the delignifying step.

8. The method of claim 7, wherein the white liquor that contacts the second gas mixture is oxidized white liquor.

9. The method of claim 7, further comprising the steps of:

peroxide bleaching the pulp after the pulp has been bleached with the second gas mixture; and delivering a second portion of the oxidized white liquor formed in the regenerating step to the peroxide bleaching step.

* * * * *